US007371950B2

(12) United States Patent
Benyahia et al.

(10) Patent No.: US 7,371,950 B2
(45) Date of Patent: May 13, 2008

(54) PLECTRUM HOLDER

(76) Inventors: Yacine Benyahia, 9, rue des Confessions, CH-1203, Genève (CH); Carmelo Tosto, 34, Chemin des Corbillettes, CH-1218, Grand Saconnex (CH)

( * ) Notice: Subject to any disclaimer, the term of this patent is extended or adjusted under 35 U.S.C. 154(b) by 182 days.

(21) Appl. No.: 10/561,028

(22) PCT Filed: Jun. 17, 2004

(86) PCT No.: PCT/EP2004/006522

§ 371 (c)(1),
(2), (4) Date: Jan. 27, 2006

(87) PCT Pub. No.: WO2005/015535

PCT Pub. Date: Feb. 17, 2005

(65) Prior Publication Data

US 2006/0117931 A1 Jun. 8, 2006

(30) Foreign Application Priority Data

Jul. 17, 2003 (CH) ..... 1254/03

(51) Int. Cl.
*G10D 3/15* (2006.01)

(52) U.S. Cl. ..... 84/320

(58) Field of Classification Search ..... 84/320–322
See application file for complete search history.

(56) References Cited

U.S. PATENT DOCUMENTS

| | | | | |
|---|---|---|---|---|
| 3,442,169 | A | 5/1969 | Bowers | 84/322 |
| 3,789,720 | A | 2/1974 | McIntyre | 84/322 |
| 6,140,564 | A | 10/2000 | Pia | 84/453 |
| 2002/0178891 | A1 | 12/2002 | Atkin | 84/322 |
| 2004/0237753 | A1 * | 12/2004 | Savage | 84/322 |
| 2005/0092158 | A1 * | 5/2005 | Santa Cruz et al. | 84/322 |

FOREIGN PATENT DOCUMENTS

| | | |
|---|---|---|
| DE | 314513 | 9/1919 |
| DE | 85 06 896 | 8/1985 |
| DE | 201 14 315 | 1/2002 |
| DE | 102 31 271 | 1/2004 |
| EP | 0 016 439 | 10/1980 |

OTHER PUBLICATIONS

International search Report PCT/EP2004/00652216 Dec. 2004.

* cited by examiner

*Primary Examiner*—Kimberly Lockett
(74) *Attorney, Agent, or Firm*—Ostrolenk, Faber, Gerb & Soffen, LLP

(57) ABSTRACT

A plectrum holder and a plectrum in the form of a ring comprising catching means. The ring is placed on the index finger of a user and is embodied in such a way as to retain the plectrum against a planar surface located on the outer rim of the ring.

2 Claims, 1 Drawing Sheet

PLECTRUM HOLDER

CROSS REFERENCE TO RELATED APPLICATION

The present application is a 35 U.S.C. §§ 371 national phase conversion of PCT/EP2004/006522, filed 17 Jun. 2004, which claims priority of Swiss Application No. 01254/03, filed 17 Jul. 2003. The PCT International Application was published in the French language.

SUMMARY OF THE INVENTION

The object of the invention is a plectrum holder and plectrum.

Musicians who use a guitar or a bass vibrate the strings of their instrument either with their fingers or with a plectrum or mediator. The plectrum, or mediator, is a tab held between the user's thumb and index finger, and allows for a different sound to be obtained from the sound obtained when the fingers are used to vibrate the strings of the instrument. The musician using the guitar or bass may find it useful to play with his fingers for a time and then quickly switch to using a plectrum or a mediator, and vice versa.

The purpose of the invention is to allow for switching from use with a plectrum to use without a plectrum, that is, with the fingers, without the user having to put the plectrum down. Conversely, when the user wishes to return to the plectrum after use with his fingers, he has to find where he put the plectrum and pick it back up between the thumb and index finder to continue playing. The purpose of the invention is to eliminate this inconvenience, and to allow the user to keep the plectrum near his fingers and be able to pick it back up instantly.

The plectrum holder according to the invention is characterised in that it is in the form of a ring designed to be placed on the index finger of a user, the ring comprising securing means designed to hold a plectrum against its outer surface.

The securing means can comprise a flat magnetic surface against which the plectrum is positioned, itself having at least one conductive section designed to cooperate with the magnetic surface. The conductive section of the plectrum can consist of a metal plate.

The metal plate can have an elongated shape designed to be placed on the magnetic surface in a predetermined position.

Alternatively, the plectrum holder can have securing means comprising a flat surface and a spring tab designed to push and hold the plectrum against the flat surface.

The plectrum holder can be in the form of a close ring or in the form of a ring with an opening opposite the flat surface, the ring thus being made up of the aforementioned surface with its securing means, and two flexible arms clasping the user's index finger.

Drawing 1 shows, as an example, two embodiments of the plectrum holder that is the object of the invention.

DESCRIPTION OF PREFERRED EMBODIMENTS

Figure 1:
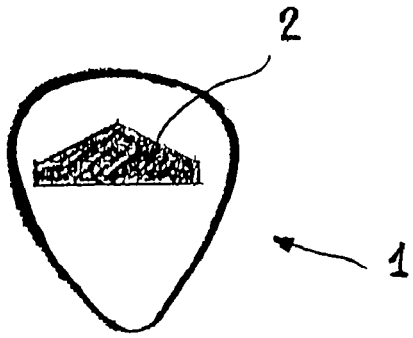
FIG. 1 shows a plectrum or mediator
Figure 4:
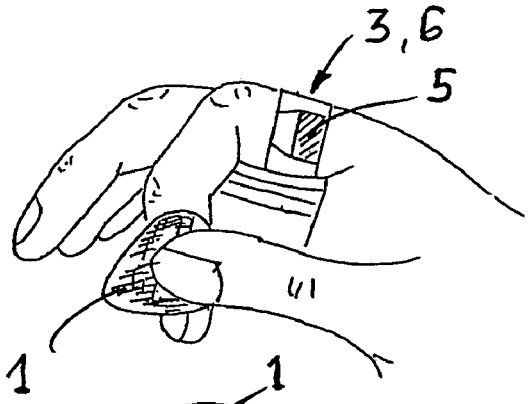
FIG. 4 shows the hand of a user who has put the plectrum holder on his index finger, and is holding the plectrum in his fingers.

FIG. 1 in the drawing shows a plectrum or mediator 1 in the form of an elongated disc. The plectrum 1 is normally made from plastic, and is designed to be held between the user's thumb and index finger as shown in FIG. 4. It is used to vibrate the strings of a guitar or bass. As shown in FIG. 1, the plectrum 1 comprises an elongated conductive surface, applied permanently to the plectrum. This conductive surface 2 is normally a metal plate. It is obvious that the metal surface 2 can be replaced by an integral conductive section forming part of the plectrum 1. Alternatively, the plectrum 1 can be made from a conductive material.

Figure 2:
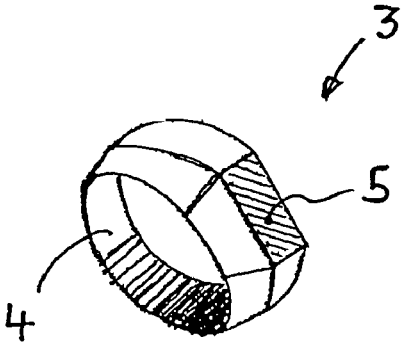
FIG. 2 shows a first embodiment of the plectrum holder

The plectrum holder 3 shown in FIG. 2 is in the form of a ring 4 with a flat surface 5 on its outer circumference. The surface 5 is a magnetic surface designed to attract the metal surface 2 of the plectrum 1. As shown in the drawing, as the surfaces 2 and 5 are elongated, the plectrum will automatically be positioned in the position shown in FIG. 5 when it is brought near the ring 3.

Figure 5:
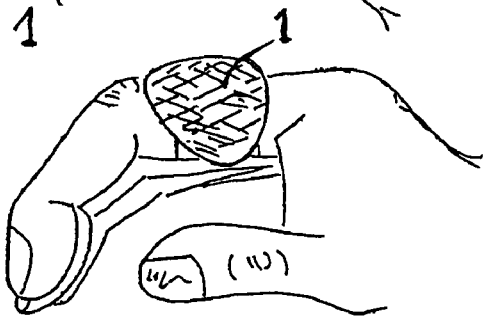
FIG. 5 is a view of the user's hand, the plectrum being positioned and held by the plectrum holder.

The use of the plectrum holder is very simple, and is in particular shown in FIGS. 4 and 5. In these figures, the plectrum holder is held between the user's thumb and index finger, as shown in FIG. 4. When the user no longer wishes to use the plectrum, he will bring the plectrum 1 against the surface 5 of the plectrum holder 3 with his thumb. The plectrum will thus be held in the position shown in FIG. 5 and the user can then continue to play with his fingers. When he wishes to use the plectrum 1 again, he can use his thumb to slide the plectrum 1 along his index finger, and take it between his thumb and index finger again.

Figure 3:
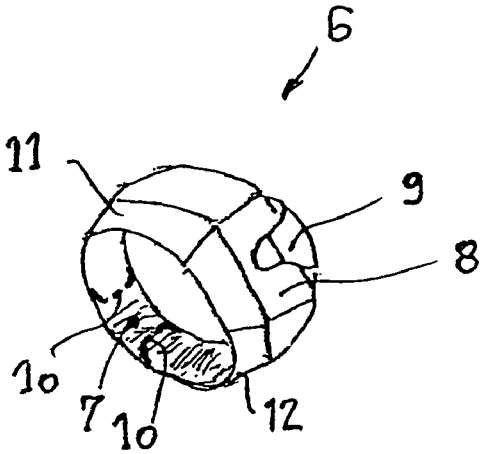
FIG. 3 shows a second embodiment of the plectrum holder

In the embodiment in FIG. 3, the plectrum holder 6 is also in the form of a ring very similar to the embodiment in FIG. 2. The plectrum holder 6 also has a flat surface 8 designed to hold the plectrum. The surface 8 is partly covered by a spring tab 9 designed to hold the plectrum 1 after it has been inserted between the surface 8 and the tab 9. The plectrum 6[1] is used in the same way as the plectrum in FIG. 2. When the user, holding the plectrum between his thumb and index finger, wishes to play with his fingers, he brings the plectrum 1 against the surface 10 with his thumb and the aforementioned plectrum is held by the tab 9. Conversely, when he wishes to take the plectrum again, he simply has to bring his thumb up to the level of the first knuckle on his index finger, exert pressure on the plectrum 1 and bring it down to the end of his index finger with his thumb.

[1] Translator's note: The original text contains a typing error, as the plectrum is numbered 1, and the plectrum holder is numbered 6.

The ring 6 shown in FIG. 3 can have an open part 7 opposite the part of the plectrum holder bearing the surface 8. The ring is thus interrupted along the lines 10 in FIG. 3, and is thus in the form of two arms 11 and 12 placed on either side of the central part bearing the flat surface 8. The arms 11 and 12 will preferably have a certain flexibility so that they clasp the user's index finger.

When it is used with the embodiment of the plectrum holder in accordance with FIG. 3, the plectrum or mediator does not have a conductive surface 2 as shown in FIG. 1.

The invention claimed is:

1. A plectrum holder in combination with a plectrum, the plectrum holder comprising:

a finger ring operable to be placed on an index finger of a user, the finger ring having an outer surface and a flat elongated magnetic surface formed on the outer surface, the plectrum being positioned against the flat elongated magnetic surface of the finger ring; and the plectrum comprising:

at least one elongated conductive section operable to cooperate with the flat elongated magnetic surface of the finger ring to secure the plectrum at a predetermined position of the finger ring.

2. Plectrum holder according to claim 1, wherein the conductive section of the plectrum is a metal plate.

* * * * *